US005697533A

United States Patent [19]

Shahbazian

[11] Patent Number: 5,697,533

[45] Date of Patent: Dec. 16, 1997

[54] DISPENSING CLOSURE

[76] Inventor: Sergik S. Shahbazian, 2340 Sigouin, #3, Ville St. Laurent, Quebec, Canada, H4R 1L7

[21] Appl. No.: 559,299

[22] Filed: Nov. 15, 1995

[51] Int. Cl.[6] ..... B67D 3/00

[52] U.S. Cl. ..... 222/480; 222/561

[58] Field of Search ..... 222/480, 561, 222/565

[56] References Cited

U.S. PATENT DOCUMENTS

| | | | |
|---|---|---|---|
| 2,878,971 | 3/1959 | Malachick | 222/490 X |
| 3,332,586 | 7/1967 | Amburgey | 222/480 |
| 3,355,069 | 11/1967 | Miles | 222/561 X |
| 4,925,067 | 5/1990 | Zemlo et al. | 222/561 X |
| 5,425,483 | 6/1995 | Mertes | 222/561 |

FOREIGN PATENT DOCUMENTS

| | | | |
|---|---|---|---|
| 2295889 | 7/1976 | France | 222/480 |

*Primary Examiner*—Kevin P. Shaver

[57] ABSTRACT

The present invention relates to a dispensing cap of the shake and spoon type wherein there are provided slidable members fitting within a groove formed within the cap to covering the openings and which slidable members always remain within the periphery of the cover member even when one of the apertures is opened for access to the container.

8 Claims, 4 Drawing Sheets

DISPENSING CLOSURE

FIELD OF THE INVENTION

The present invention relates to a dispensing cap of the type that have shake and spoon apertures formed therein.

DESCRIPTION OF THE PRIOR ART

The use of shake and spoon containers for dispensing condiments such as spices and the like is well known in the art. Generally, the containers have a mouth which is frequently of a cylindrical configuration and may be formed of a suitable glass, plastic or metallic material. The closure or cover member is also formed of one of many suitable materials and has one relatively large opening so that a spoon or other instrument can be inserted into the container to remove the material in larger volumes—i.e. the spoon aperture. The container will also normally contain a shaking arrangement wherein a plurality of smaller apertures are formed.

While a number of such closures are readily available, there are certain disadvantages. Initially, it is generally desired that the closure be formed of a plastic material so that it can be economically molded. Depending upon the particular arrangement employed, a number of different pieces and subsequent assembly may be required. The mating of the pieces is not always as desired and can permit accidental uncovering of one or more of the openings and/or improper sealing.

SUMMARY OF THE INVENTION

It is an object of the present invention to provide a closure for a condiment container, the closure being of the shake and spoon type wherein the closure can be readily molded and assembled and is reliable and aesthetically pleasing.

It is a further object of the present invention to provide a closure of the shake and spoon type wherein there are provided slidable members to cover the opening and which slidable members always remain within the periphery of the cover member, even when in an open position.

According to one aspect of the present invention, there is provided a closure for use with a container having a mouth, the closure comprising an upper cover portion, a skirt depending from the periphery of the cover portion, the skirt being adapted to engage a side wall of the container such that the cover portion lies adjacent to and covers the mouth of the container. The cover portion has first and second dispensing aperture means formed therein, each of the dispensing aperture means being diametrically opposed. A channel is formed within an upper surface of the cover portion and the channel extends diametrically between peripheral edges and includes the first and second dispensing aperture means. The channel is defined by a bottom surface and a pair of opposed parallel side walls, each of the side walls having an undercut portion. The closure also includes first and second slidable members, each of the slidable members being sized to fit within the channel and to be slidable therein and to be retained by the undercut portion in the side walls. The first and second slidable members are sized so as first and second dispensing aperture means respectively and to also permit sliding movement thereof to an opening position to uncover the dispensing aperture means.

In greater detail, the closure of the present invention is adapted to be used with a container whereby one desirably has the option of a bulk dispensing of the product from within the container or of utilizing a shaker type of dispensing wherein a lesser amount of material is permitted to exit from the container. As such, the material within the container will normally be in a relatively fine particulate form as is frequently the case for many herbs, spices and other condiments.

The container may be formed of any suitable material and can be of any desired configuration. However, it is conventional in the art that containers have a generally rectangular or cylindrical configuration and are of the type wherein the mouth of the container is of a circular configuration to accept a screw on closure. The container can conveniently be formed of a suitable material with glass and plastic being the most widely used materials.

The closure of the present invention is preferably formed of a plastic material and for economy and ease of manufacture, it is preferably formed of a polyethylene material. As aforementioned, most containers have a generally circular mouth and accordingly, the container would have a like configuration although it is within the scope of this invention that other configurations could be used with suitable means for attaching the closure to the container.

The closure includes an upper cover portion with a skirt depending therefrom and which skirt will engage the walls of the container in a locking relationship. Normally, this would be means of a screw threaded engagement with the container walls.

The cover will include first and second dispensing aperture means and as is conventional in the art, the first one of the dispensing aperture means will comprise means for bulk dispensing by means of a spoon or pouring. As such, this first dispensing aperture means will normally consist of a first aperture formed within the cover portion to permit access to the interior by measuring spoons and the like.

The second dispensing aperture means will conventionally comprise a plurality of smaller apertures to permit a shaking of the container for an even distribution of the contents. Naturally, the apertures will be sized according to the particular condiment for which it is designed.

Both of the first and second dispensing aperture means are preferably located adjacent the periphery of the cover portion although with the practice of the present invention, they could also be more centrally located as the slidable sealing members would permit such placement.

A channel extends between opposed sides of the periphery of the cover member and in the case of a circular member is a diametrically extending channel. The channel is defined by a bottom surface which incorporates the first and second dispensing aperture means and a pair of opposed parallel side walls. The side walls are provided with an undercut portion which preferably is formed by the side walls being angled inwardly with respect to each other at an angle of between 55° to 65°.

A pair of slidable sealing elements are adapted to mount within the channel and be slidable therein. As such, the slidable sealing elements have a portion adjacent their side which would be adapted to engage with the undercut portion of the side walls of the channel and to be thereby retained within the channel. In some embodiments, a single slidable sealing element may be employed.

Each of the slidable sealing elements is sized to cover one of the dispensing aperture means. Conveniently, both may be of an equal size although the invention can accommodate different size sliding sealing elements.

The slidable sealing elements are also sized such that they can be slid from a sealing relationship with respect to the dispensing aperture to a non sealing relationship while remaining within the periphery of the cover member. In a conventional arrangement, the first and second dispensing aperture means would each be located adjacent the periphery of the cover portion and the slidable sealing elements would have a length one third or less than the diameter of the cover member. Thus, the sealing element could be slid inwardly to uncover the dispensing aperture. This movement would also ensure that the second slidable sealing element would be retained in a sealing relationship with the first dispensing aperture.

Means are preferably provided for locking the sealing elements such that they cannot be accidentally removed. As such, a stop member may be provided which will engage with a groove in the bottom of the slidable sealing elements. The top element may conveniently comprise a boss formed in the upper surface in the channel. The boss may be chamfered so as to permit ready assembly of the sliding sealing elements.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
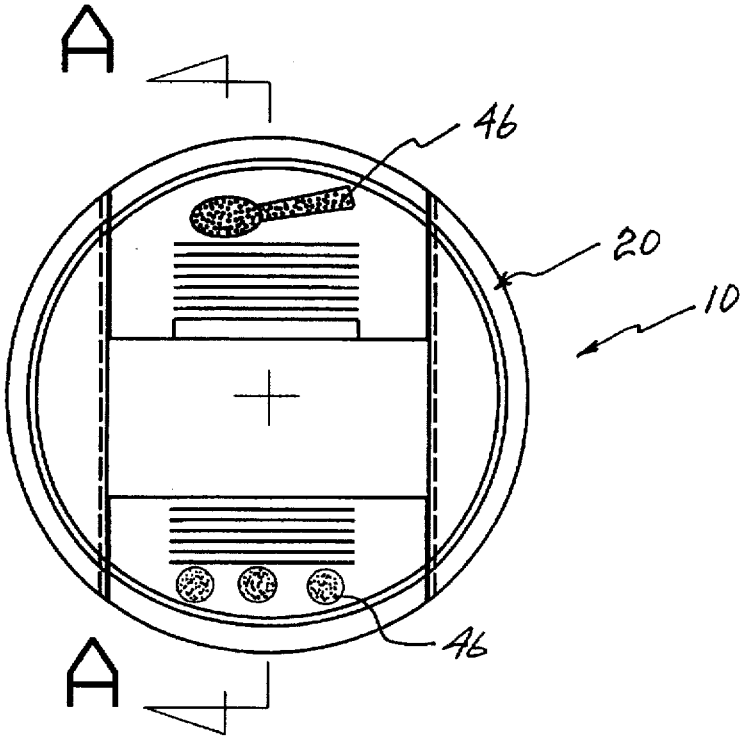
FIG. 1 is a top plan view of a closure according to the present invention.

Referring to the drawings in greater detail and by reference characters thereto, there is provided a closure generally designated by reference numeral 10 and which includes a disk shaped cover portion 12 having an annular skirt 14 depending therefrom. Annular skirt 14 has formed, on an interior surface thereof, threads 16 for engagement with a side wall of a container.

Cover portion 12 has, on an upper surface thereof, a raised land portion 18 which is surrounded by an annular peripheral recess 20. Formed with raised land portion 18 is a diametrically extending channel 22 which is defined by a surface 24 and a pair of inwardly angled side walls 26 and 28 to thereby provide an undercut portion in each of the side walls 26 and 28.

Formed within surface 24 is a bulk dispensing aperture 30 and which is located at one end of channel 22 while at the opposed end there are provided a plurality of smaller apertures 32.

It will be noted that surface 24 of channel 22 also includes upwardly extending bosses 34 and 36 adjacent apertures 30 and 32 respectively.

The invention includes a pair of slidable sealing members 38 and 38'. Each member is substantially identical in a structural sense although it will be noted that sealing element 38' has a slightly greater length as required to cover the larger dispensing aperture 30. Thus, similar reference numerals are employed with larger sealing element 38' having components designated by a prime.

Sealing element 38 includes an upper surface 42, a bottom surface 48, and a pair of side walls 50 and 52. Formed within upper surface 42 is a finger engaging portion which may comprise a plurality of alternating grooves and ridges 44. A recess 45 is provided in sealing member 38'. Suitable indicia 46 may also be molded into the upper surface to indicate what type of dispensing aperture is associated therewith.

Figure 2:
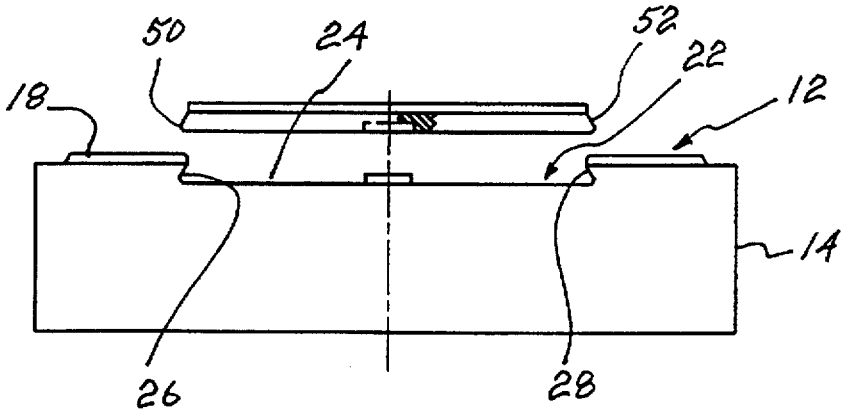
FIG. 2 is a side elevational view of the closure with one of the sealing elements in a raised position.
Figure 3:
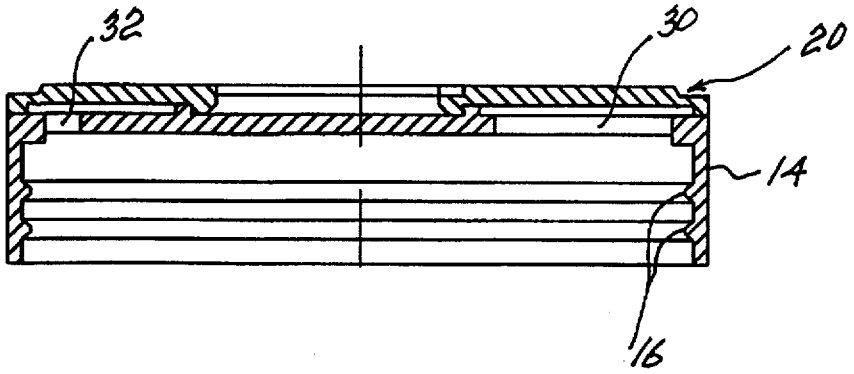
FIG. 3 is a sectional view taken along the lines A—A of FIG. 1.

As will be noted in FIG. 2, side walls 50 and 52 have an angled or tapered configuration such that bottom surface 48 is somewhat larger than upper surface 42 whereby the side walls are engaged and held by the undercut formed in side walls 26 and 28. It will also be noted that bottom surface 48 includes a groove 54 formed therein and which groove is adapted to be engaged by boss 34.

Figure 4:
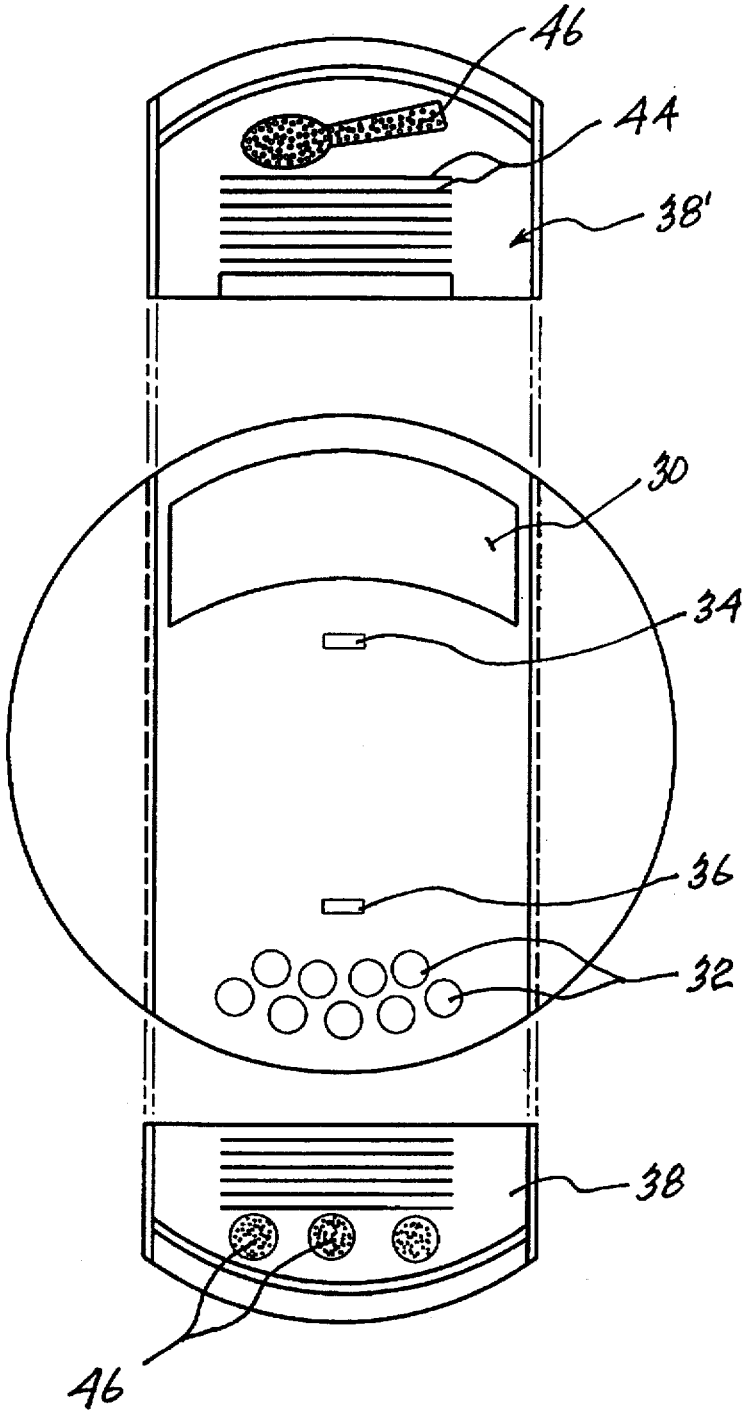
FIG. 4 is a top plan view showing assembly of the slidable sealing elements within the channel of the cover.
Figure 5:
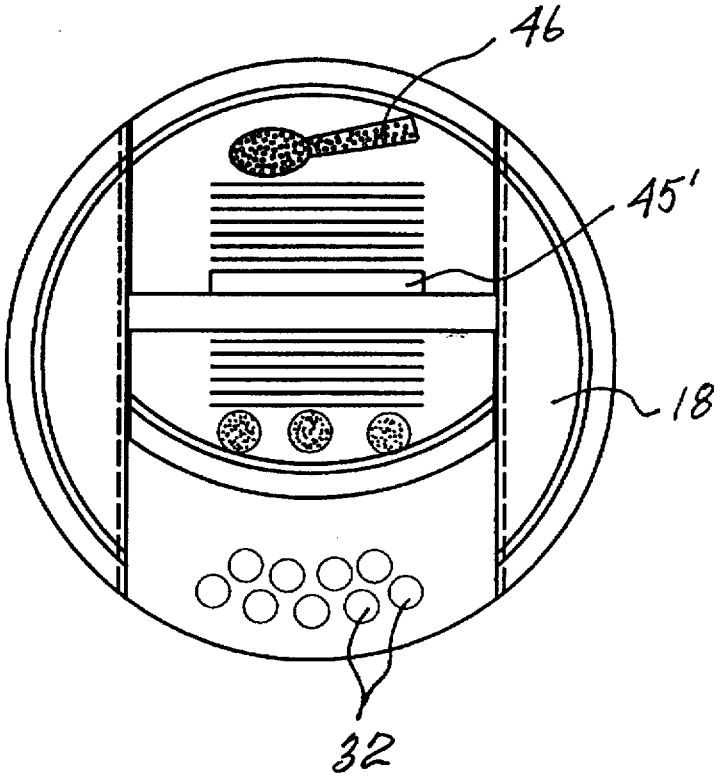
FIG. 5 is a top plan view illustrating movement of one of the sealing elements so that access is provided to a first dispensing aperture means.
Figure 6:
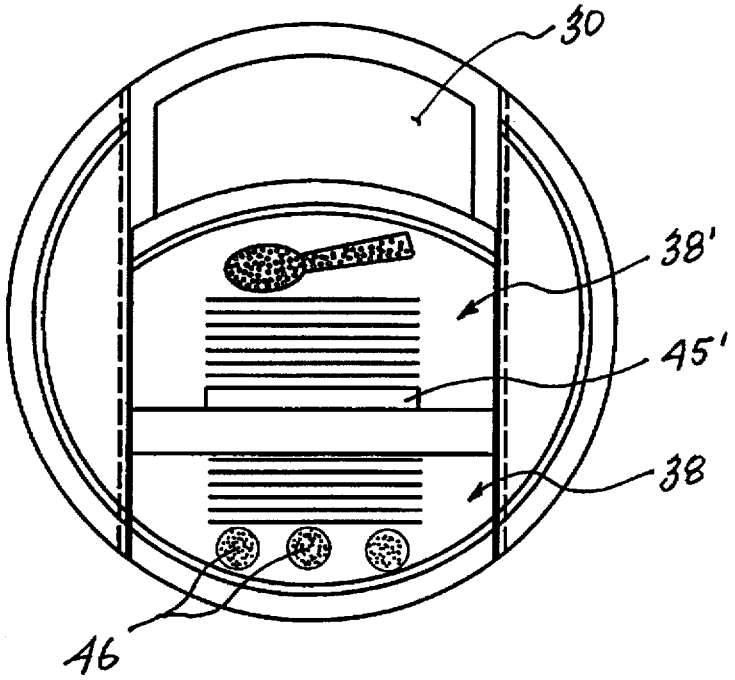
FIG. 6 is a view similar to FIG. 6 showing movement of the second sealing element to provide access to a second dispensing aperture means.
Figure 7:
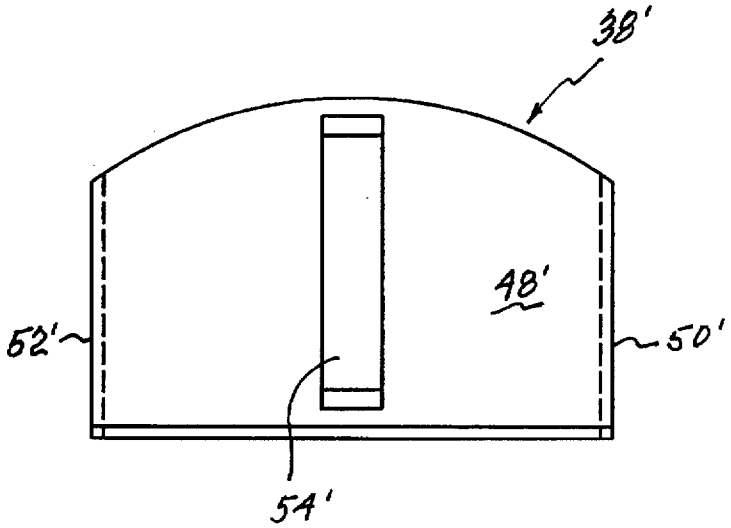
FIG. 7 is a top plan view of the second sealing element.
Figure 7A:
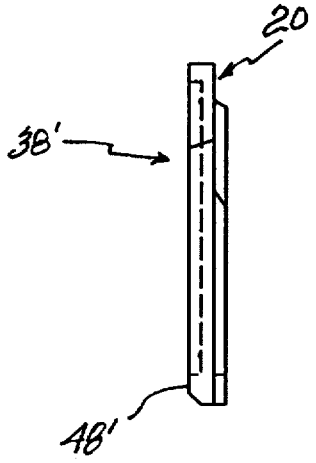
FIG. 7*a* is a side elevational view thereof.
Figure 8:
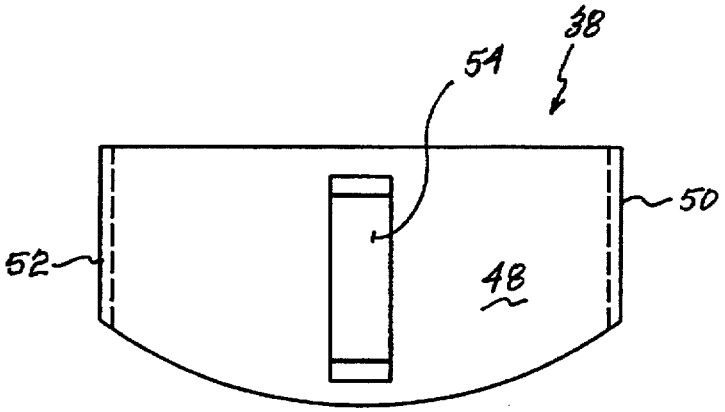
FIG. 8 is a top plan view of the first slidable sealing element.
Figure 8A:
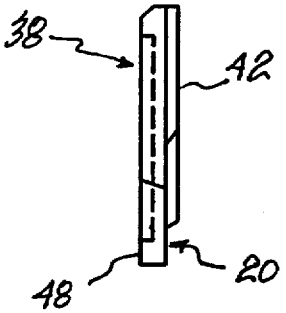
FIG. 8*a* is a side elevational view thereof.

Following manufacture of the components and as shown in FIG. 4, sealing element 38 and 38' may easily be slid within channel 22 and to this end, either bosses 34, 36, or a leading edge of the sealing elements, 38,38' may have a chamfered wall to permit easy assembly of the sealing elements. Once engaged, the inter-engagement of the bosses with the grooves in the underside prevents removal. As seen in FIG. 5 and 6, either of sliding sealing elements 38 or 38' may be moved to a central location so as to permit ready access to the dispensing apertures.

It will also be noted that the provision of the annular recess 20 can permit the stacking of multiple containers.

It will be understood that the above described embodiment is for purposes of illustration only and that changes and modifications may be made thereto without departing from the spirit and scope of the invention.

I claim:

1. A closure for use with a container having a mouth, the closure comprising an upper cover portion, a skirt depending from the periphery of said cover portion, said skirt being adapted to engage a side wall of the container such that said cover portion lies adjacent to and covers said mouth of said container, said cover portion having first and second dispensing aperture means formed therein, each of said first and second dispensing aperture means being diametrically opposed, a channel being formed within an upper surface of said cover portion, said channel extending diametrically between peripheral edges and including said first and second dispensing aperture means, said channel being defined by a bottom surface and a pair of opposed parallel side walls, each of said side walls having an undercut portion formed therein, first and second slidable members, each of said slidable members being sized to fit within said channel and to be slidable therein and to be retained by said undercut portion of said side walls, said first and second slidable members being sized so as to cover said first and second dispensing aperture means respectively and to also permit sliding movement within said channel to an opening position to uncover said first and second dispensing aperture means respectively.

2. The closure of claim 1 wherein said first and second dispensing aperture means are each located adjacent the periphery of said cover.

3. The closure of claim 2 wherein each of said slidable members are of a different size.

4. The closure of claim 1 wherein said closure is formed of a moldable plastic material.

5. The closure of claim 1 wherein said undercut portion of said side walls are formed at an angle of between 55° and 65° with respect to said bottom surface of said channel.

6. The closure of claim 1 further including first and second bosses formed on said bottom surface of said channel, each of said slidable members having a groove formed in a bottom surface thereof, said bosses being adapted to engage within said groove to permit movement between an open position and a closed position.

7. The closure of claim 6 wherein each of said bosses has a chamfered edge to permit easy assembly of said slidable members within said channel.

8. The closure of claim 4 wherein said closure is formed of a polyethylene material.

* * * * *